US010551127B2

(12) United States Patent
Park et al.

(10) Patent No.: US 10,551,127 B2
(45) Date of Patent: Feb. 4, 2020

(54) HEAT EXCHANGER

(71) Applicant: LG ELECTRONICS INC., Seoul (KR)

(72) Inventors: Taegyun Park, Seoul (KR); Sehyeon Kim, Seoul (KR); Seungmo Jung, Seoul (KR); Eungyul Lee, Seoul (KR); Sanghoon Yoo, Seoul (KR); Naehyun Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/397,120

(22) PCT Filed: Apr. 19, 2013

(86) PCT No.: PCT/KR2013/003362

§ 371 (c)(1),
(2) Date: Oct. 24, 2014

(87) PCT Pub. No.: WO2013/162222

PCT Pub. Date: Oct. 31, 2013

(65) Prior Publication Data

US 2015/0114030 A1 Apr. 30, 2015

(30) Foreign Application Priority Data

Apr. 26, 2012 (KR) ..... 10-2012-0043723

(51) Int. Cl.
*F28D 1/053* (2006.01)
*F25B 39/04* (2006.01)
(Continued)

(52) U.S. Cl.
CPC ..... *F28D 1/05325* (2013.01); *F25B 39/00* (2013.01); *F25B 39/04* (2013.01);
(Continued)

(58) Field of Classification Search
CPC ..... F28D 1/05358; F28D 1/02333; F28D 1/05325; F28D 1/0233; F28D 1/05391;
(Continued)

(56) References Cited

U.S. PATENT DOCUMENTS 2,539,669 A 3/1951 Newcome et al.
3,289,693 A * 12/1966 Scaramucci ..... F16K 15/03 137/858
(Continued)

FOREIGN PATENT DOCUMENTS

CN 1287607 A 3/2001
DE 3217836 A1 11/1983
(Continued)

*Primary Examiner* — Cassey D Bauer
*Assistant Examiner* — Jenna M Hopkins
(74) *Attorney, Agent, or Firm* — Birch, Stewart, Kolasch & Birch, LLP

(57) ABSTRACT

Provided is a heat exchanger. The heat exchanger includes a plurality of refrigerant tubes in which a refrigerant flows, a heatsink fin coupled to the plurality of refrigerant tubes to heat-exchange the refrigerant with a fluid, a header disposed on at least one side of the plurality of refrigerant tubes to define a flow space of the refrigerant and a guide device disposed in the header to partition the flow space, the guide device guiding the refrigerant from the header to the refrigerant tubes. The guide device includes a movable cover part.

3 Claims, 11 Drawing Sheets

(51) Int. Cl.

| | |
|---|---|
| ***F28D 1/02*** | (2006.01) |
| ***F28F 9/02*** | (2006.01) |
| ***F25B 39/00*** | (2006.01) |
| ***F28F 27/02*** | (2006.01) |
| *F28D 21/00* | (2006.01) |

(52) U.S. Cl.
CPC ..... *F28D 1/0233* (2013.01); *F28D 1/05358* (2013.01); *F28D 1/05391* (2013.01); *F28F 9/0209* (2013.01); *F28F 9/0212* (2013.01); *F28F 9/0236* (2013.01); *F28F 27/02* (2013.01); *F25B 2339/0444* (2013.01); *F28D 2021/007* (2013.01); *F28D 2021/0071* (2013.01)

(58) Field of Classification Search
CPC ..... F28D 2021/0071; F28D 2021/007; F28F 9/0236; F28F 9/0209; F28F 27/02; F25B 39/04; F25B 39/00; F25B 2339/0444
USPC ..... 165/174, 96, 175, 151, 148
See application file for complete search history.

(56) References Cited

U.S. PATENT DOCUMENTS 3,445,317 A * 5/1969 Marshall ..... F24F 3/044 165/279
3,608,505 A * 9/1971 Rosenberg ..... F24C 15/322 110/212
3,675,710 A 7/1972 Ristow
3,990,504 A * 11/1976 Kolthoff, Jr. ..... F28D 1/05341 123/41.08
3,998,571 A * 12/1976 Falke ..... F04B 39/1073 417/569
4,179,051 A * 12/1979 Thomas ..... A61M 3/0262 137/454.2
4,243,094 A 1/1981 Woodhull, Jr. et al.
4,337,737 A * 7/1982 Pechner ..... F28F 27/02 123/196 AB
4,381,816 A * 5/1983 Granetzke ..... F24J 2/4634 126/588
4,593,749 A * 6/1986 Schatz ..... B60H 1/02 165/101
4,596,749 A * 6/1986 Congdon ..... H01M 2/36 429/409
5,101,640 A 4/1992 Fukushima et al.
5,141,048 A 8/1992 Sausner
5,351,664 A * 10/1994 Rotter ..... B01D 35/18 123/196 AB
5,380,176 A * 1/1995 Kikuchi ..... F04C 29/128 137/856
5,499,675 A * 3/1996 Haasch ..... F01M 5/002 165/103
5,544,699 A * 8/1996 Robers ..... F01M 1/20 165/103
5,595,214 A * 1/1997 Shaffer ..... B60K 17/20 137/513.5
5,609,476 A * 3/1997 Kim ..... F04B 39/1073 417/447
6,253,837 B1 * 7/2001 Seiler ..... F16H 57/0413 137/625.29
6,412,514 B1 * 7/2002 Raftis ..... F16K 15/148 137/111
6,430,945 B1 8/2002 Haussmann
7,306,030 B2 * 12/2007 Luvisotto ..... F16K 15/16 137/454.2
8,439,104 B2 * 5/2013 de la Cruz ..... F28D 1/05391 165/146
2002/0005281 A1 * 1/2002 Krupa ..... F28D 1/0391 165/177
2003/0019620 A1 * 1/2003 Pineo ..... F01M 5/00 165/297
2003/0188859 A1 * 10/2003 Muramoto ..... F28D 1/0435 165/297
2003/0213583 A1 * 11/2003 Kamishima ..... F25B 39/04 165/82
2008/0023182 A1 * 1/2008 Beamer ..... F28D 1/05391 165/137
2008/0264284 A1 * 10/2008 Hutchison ..... B26D 7/2614 101/389.1
2010/0095688 A1 4/2010 Taras et al.
2010/0252242 A1 * 10/2010 Xiangxun ..... F28D 1/05391 165/173
2012/0011867 A1 * 1/2012 Koons ..... F25B 39/04 62/115
2012/0132413 A1 * 5/2012 Cheadle ..... F01M 5/00 165/297

FOREIGN PATENT DOCUMENTS

| | | | |
|---|---|---|---|
| EP | 0855567 | A2 | 7/1998 |
| EP | 0 856 717 | A2 | 8/1998 |
| JP | 59-191894 | A | 10/1984 |
| JP | 10-213391 | A | 8/1998 |
| KR | 1999-0029960 | A | 4/1999 |

* cited by examiner

[Fig. 1]
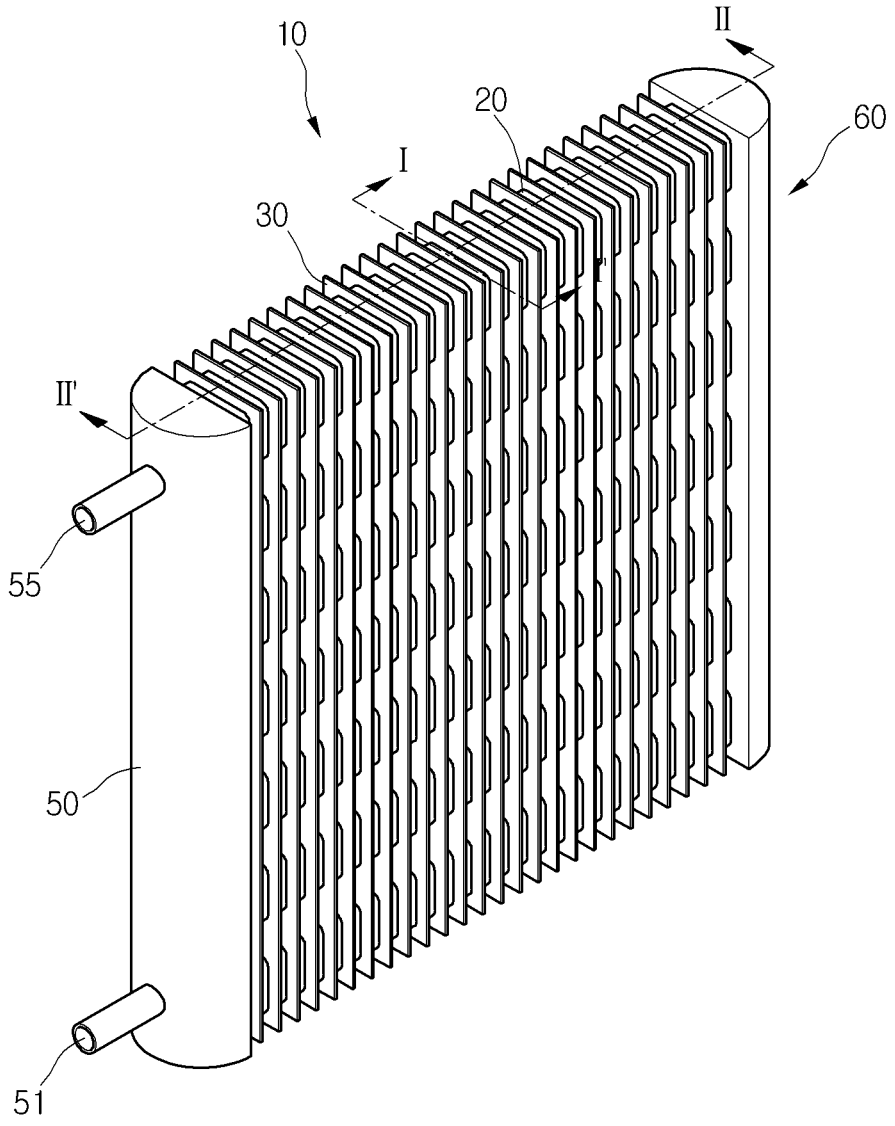

[Fig. 2]
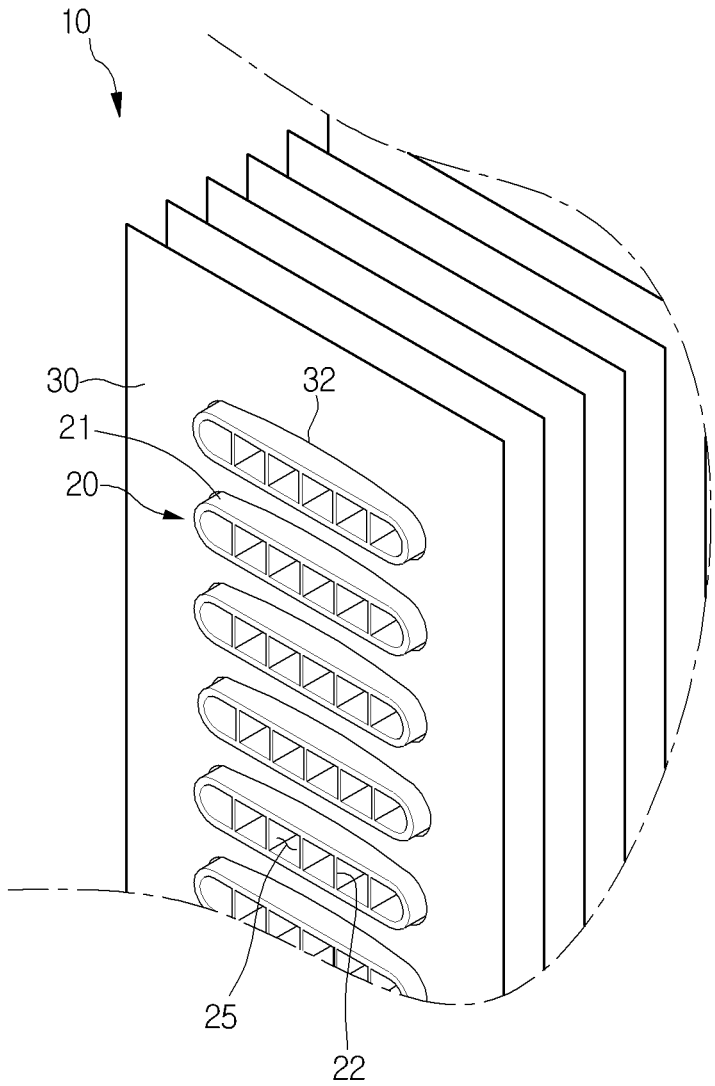

[Fig. 3]
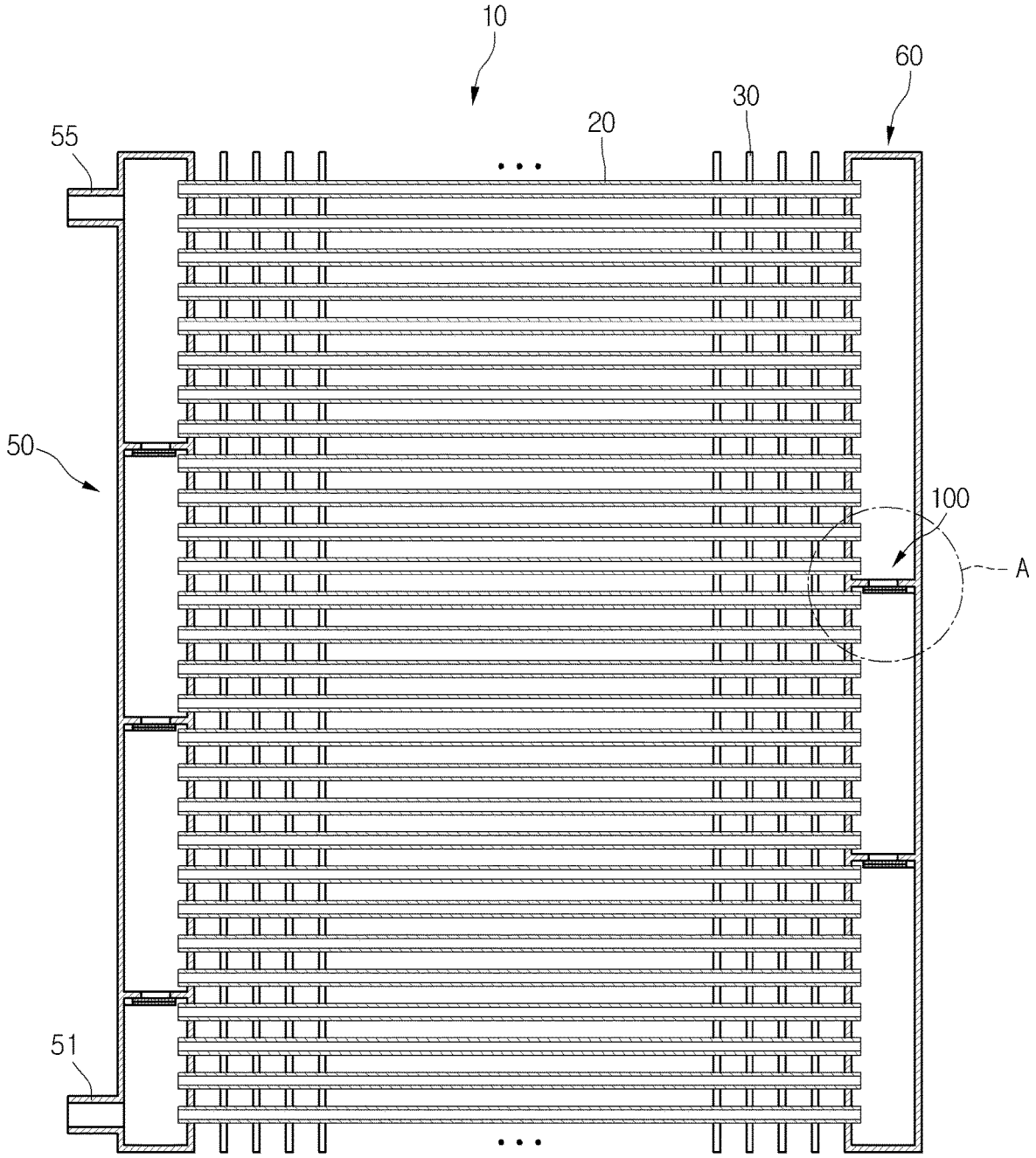

[Fig. 4]
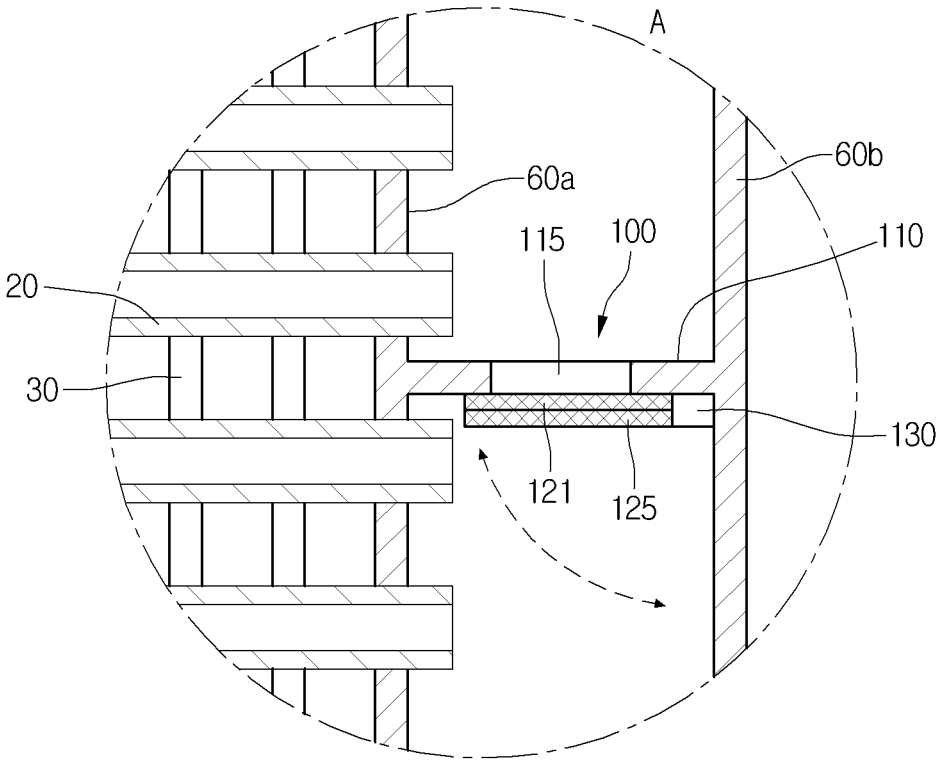

[Fig. 5]
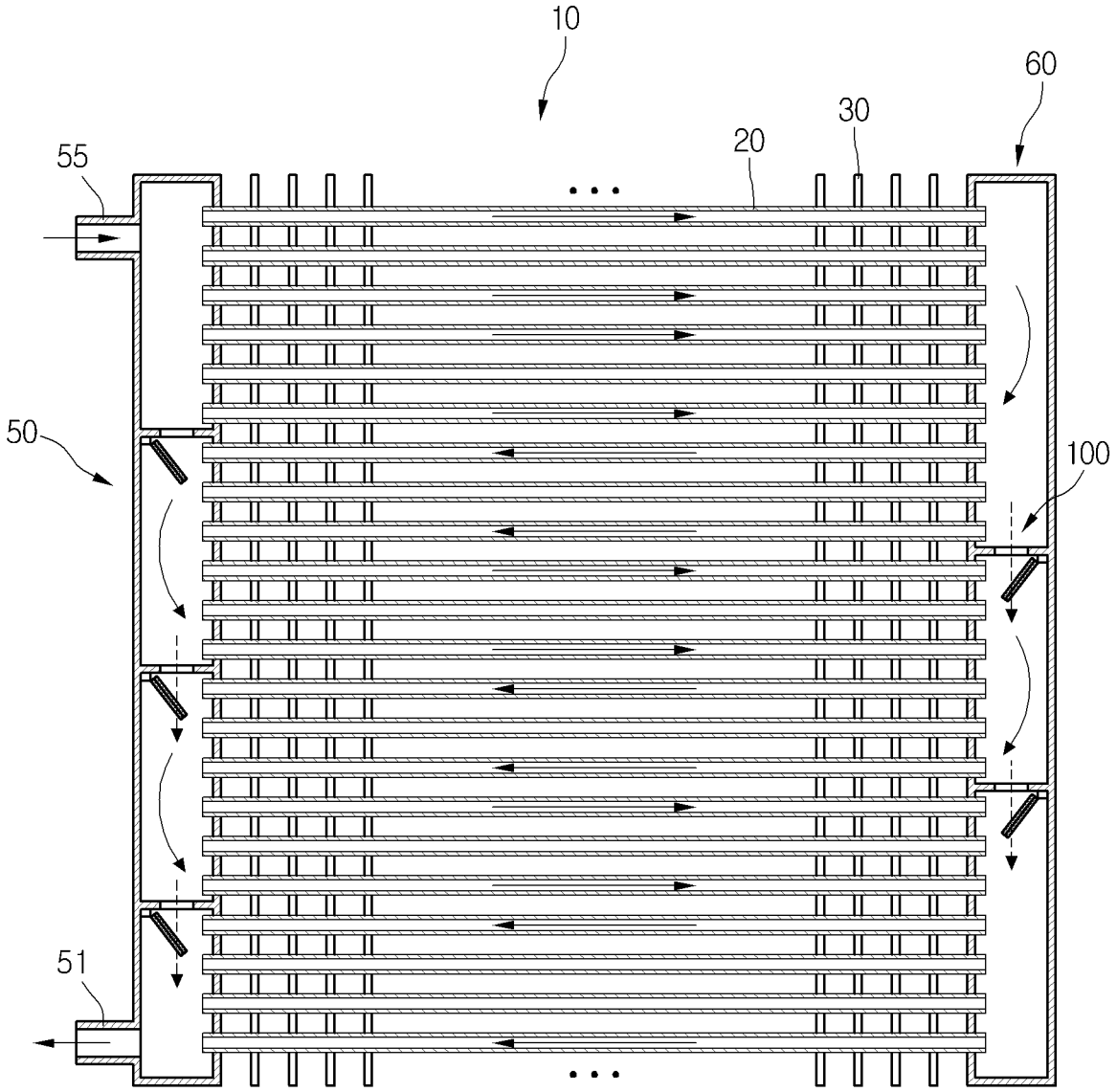

[Fig. 6]
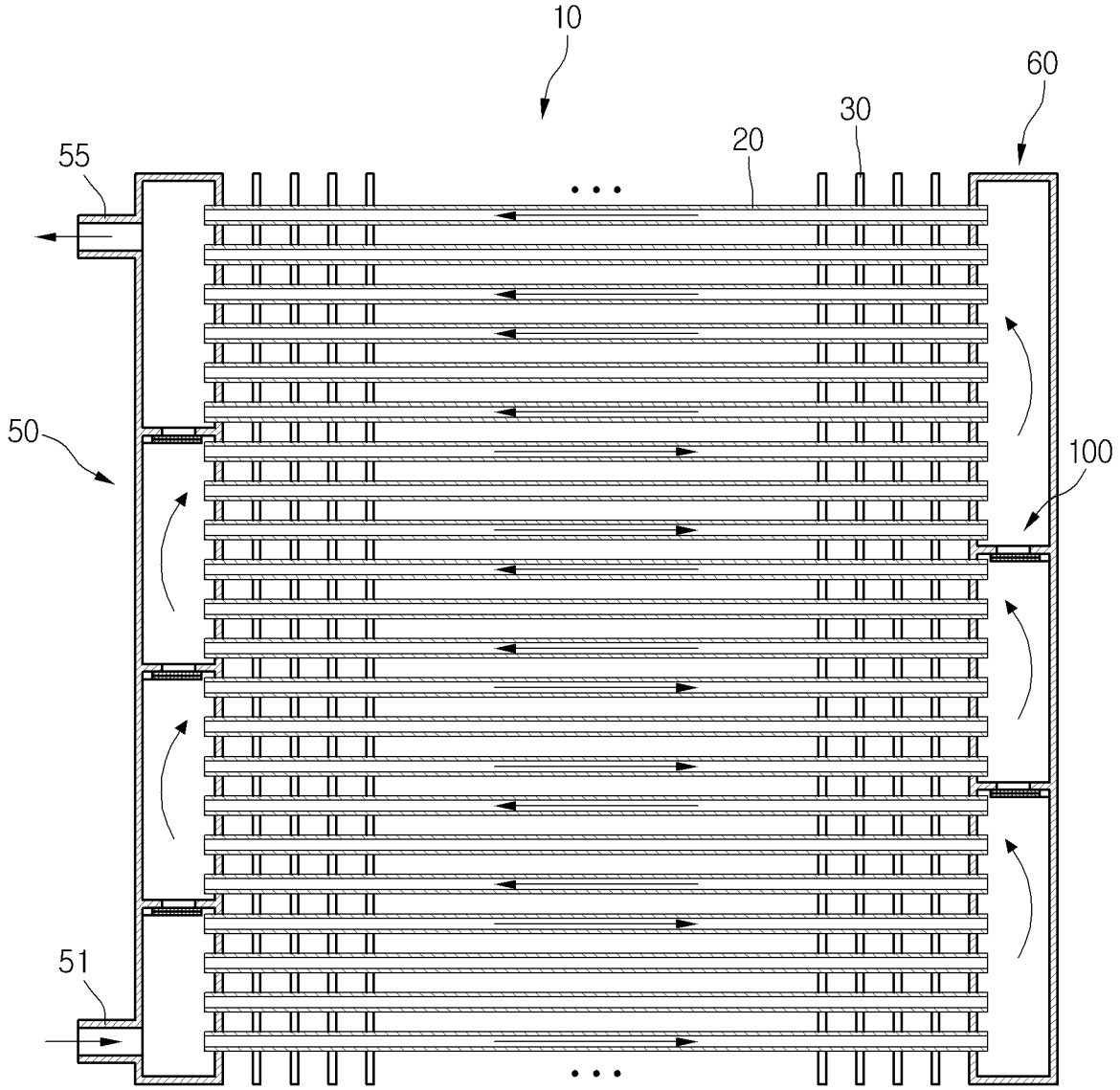

[Fig. 7]
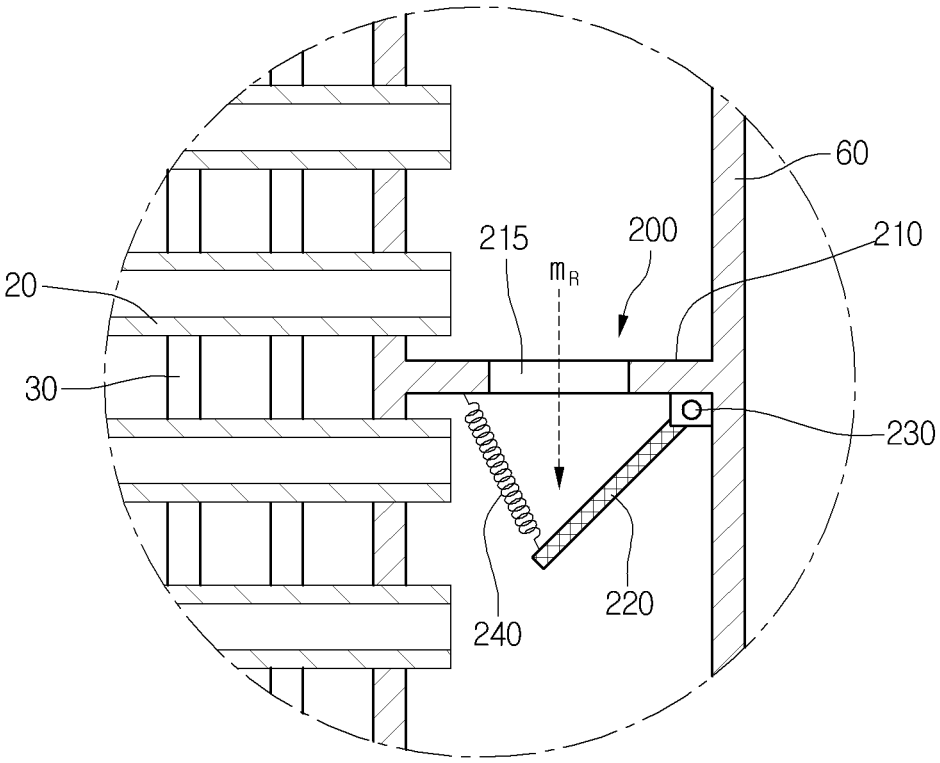

[Fig. 8]
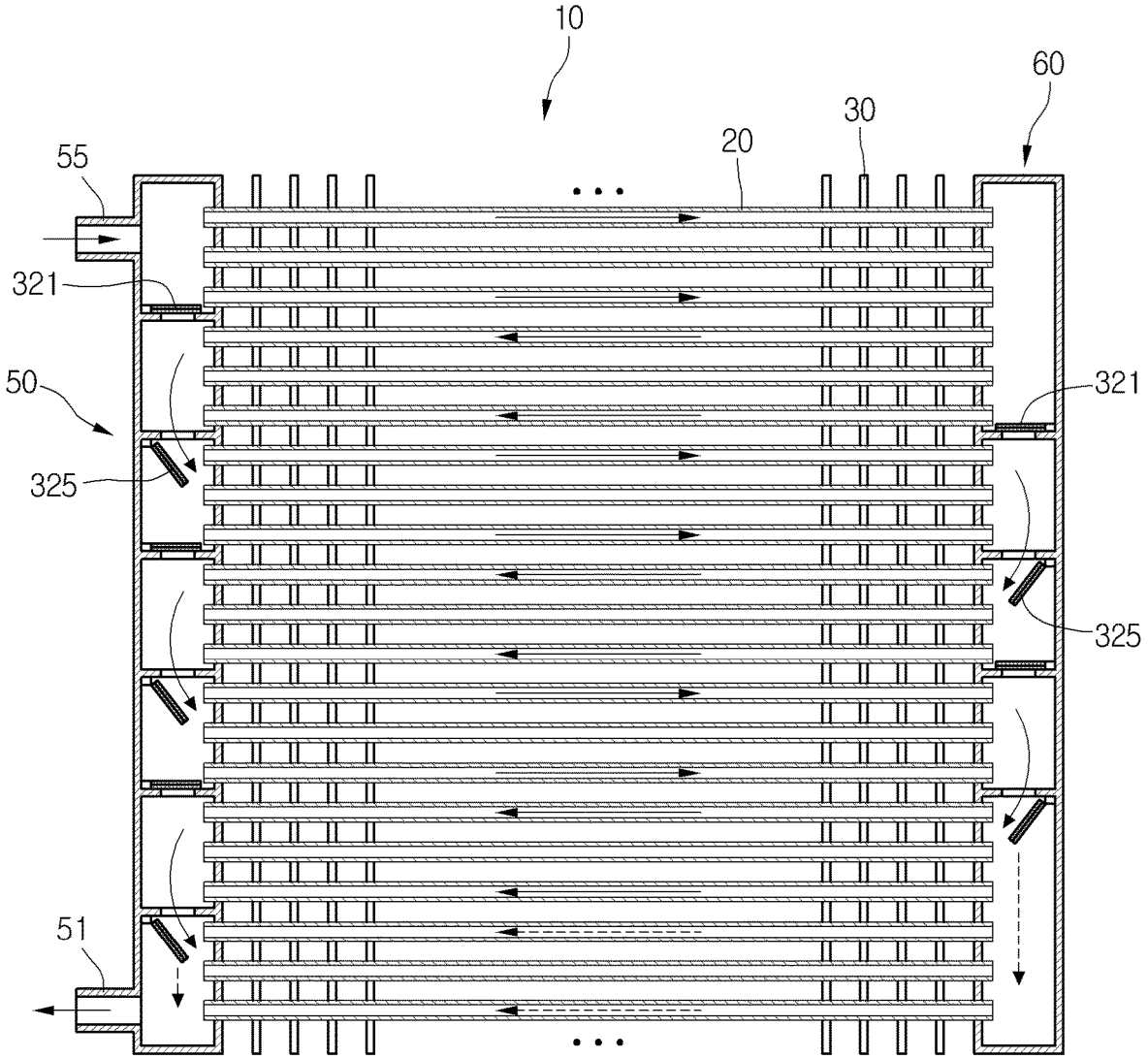

[Fig. 9]
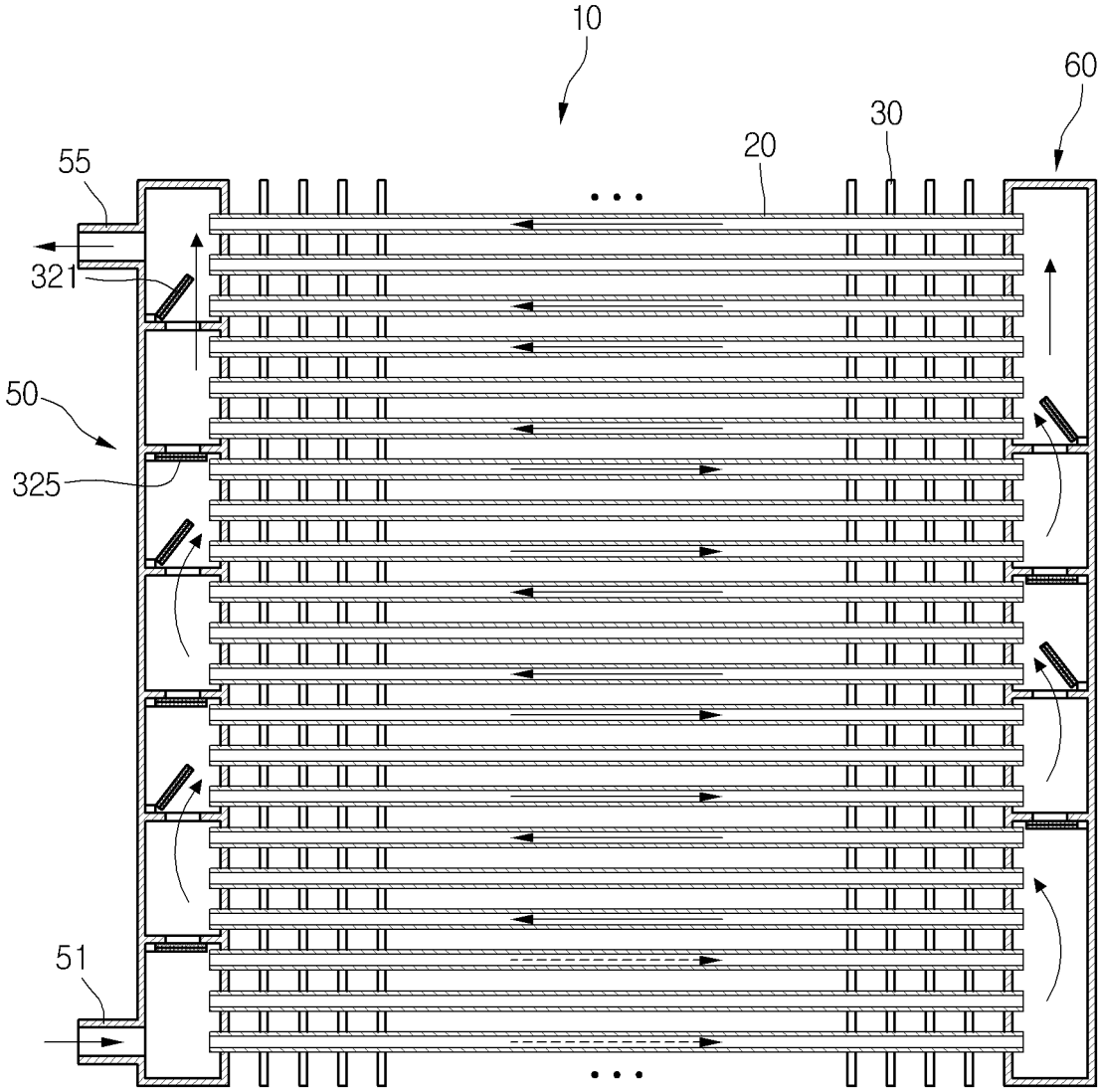

[Fig. 10]
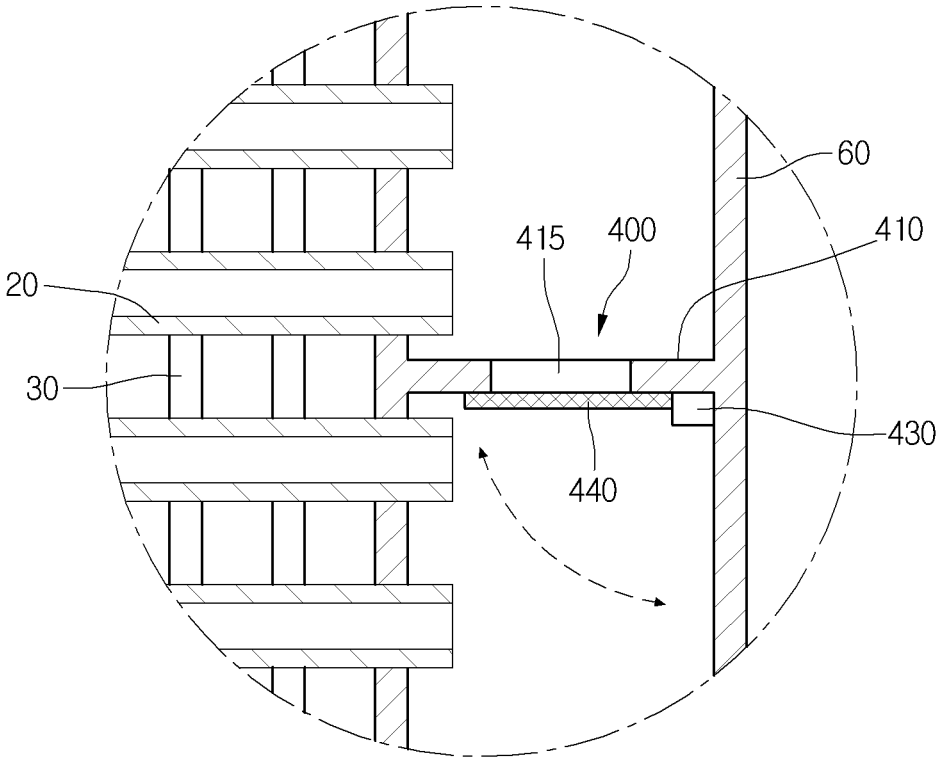

[Fig. 11]
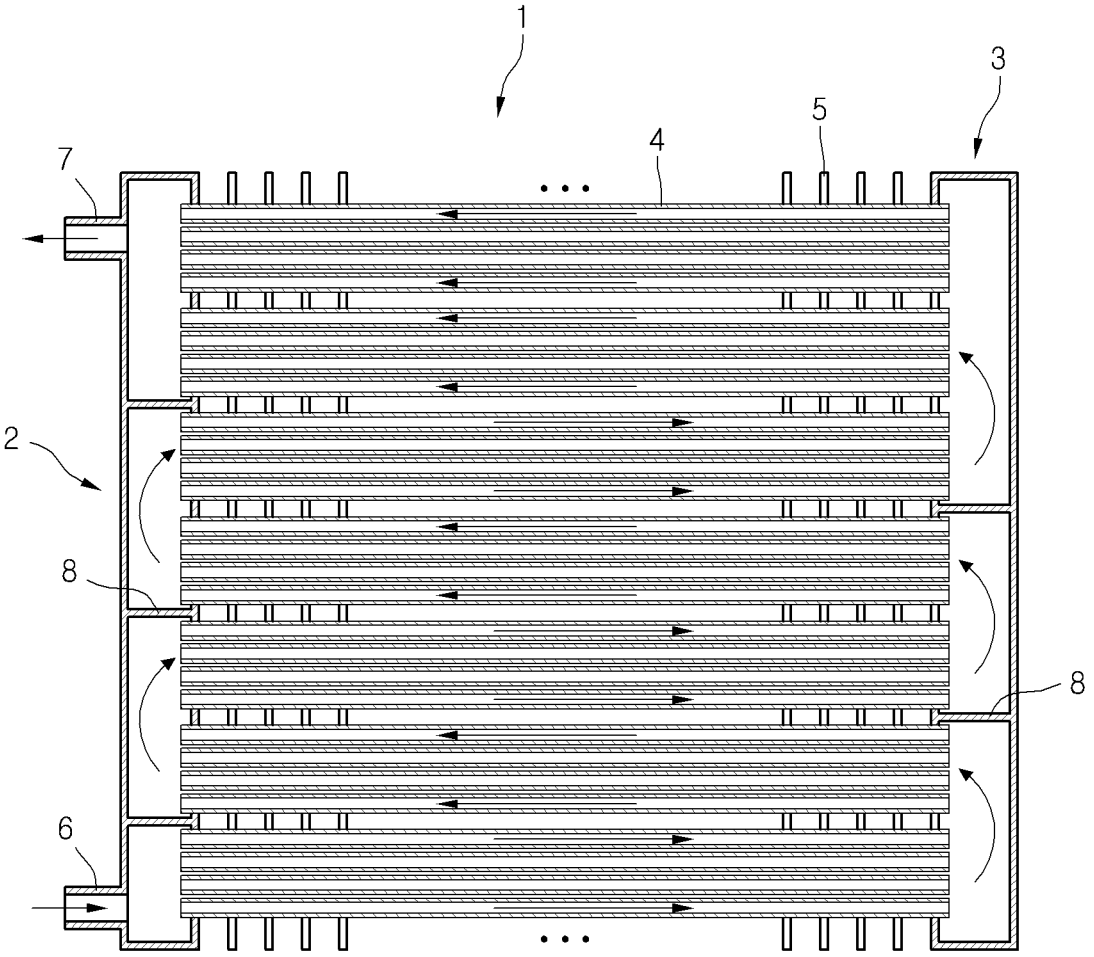
Related Art

HEAT EXCHANGER

TECHNICAL FIELD

The present disclosure relates to a heat exchanger.

BACKGROUND ART

In general, a heat exchanger is a part used in a heat-exchanging cycle. The heat exchanger may serve as a condenser or evaporator to heat-exchange a refrigerant flowing therein with an external fluid.

The heat exchanger may be largely classified into a fin-and-tube type and a micro channel type according to a shape thereof. The fin-and-tube type heat exchanger includes a plurality of fins and a tube having a circular shape or a shape similar to that circular shape and passing through the fins. The micro channel type heat exchanger includes a plurality of flat tubes through which a refrigerant flows and a fin disposed between the plurality of flat tubes. In all of the pin-and-tube type heat exchanger and the micro channel type heat exchanger, a refrigerant flowing into the tube or flat tubes is heat-exchanged with an external fluid. Also, the fin may increase a heat exchange area between the refrigerant flowing into the tubes or flat tubes and the external fluid.

A heat exchanger may be used for an air conditioner as one part of a refrigerating cycle. Also, according to an operation mode of the air conditioner, the heat exchanger may serve as a condenser for condensing a refrigerant or an evaporator for evaporating the refrigerant. For example, when the heat exchanger serves as the condenser in a cooling operation of the air conditioner, the heat exchanger may serve as the evaporator in a heating operation.

Referring to FIG. 11, when a heat exchanger 1 serves as an evaporator, the micro channel type heat exchanger 1 according to the related art includes headers 2 and 3 coupled to a plurality of flat tubes 4. The headers 2 and 3 are provided in plurality. The first header 2 of the plurality of headers 2 and 3 is coupled to one side of the plurality of flat tubes 4, and the second header 3 is coupled to the other side of the plurality of flat tubes 4. Also, a heatsink fin 5 for easily heat-exchanging a refrigerant with external air is disposed between the plurality of flat tubes 4.

The first header 2 includes a refrigerant inflow part 6 through which the refrigerant is introduced into the heat exchanger 1 and a refrigerant discharge part 7 through which the refrigerant heat-exchanged within the heat exchanger 1 is discharged. The refrigerant inflow part 6 may be disposed on a lower portion of the first header 2, and the refrigerant discharge part 7 may be disposed on an upper portion of the first header 2.

Also, a baffle 8 for guiding a flow of the refrigerant is provided within the first and second headers 2 and 3. The baffle 8 is fixed within the first and second headers 2 and 3. The refrigerant within the first or second header 2 or 3 may be switched in flow direction by the baffle 8 to flow into the flat tubes 4.

The refrigerant introduced into the heat exchanger 1 may have a two-phase state. On the other hand, the refrigerant just before being discharged from the heat exchanger 1 may be a gaseous refrigerant or have a two-phase state having a very high dryness degree. That is, the refrigerant flowing into the flat tubes 4 may include a two-phase refrigerant in which a liquid refrigerant and a gaseous refrigerant are mixed with each other at a predetermined ratio.

When the two-phase refrigerant flows into the flat tubes 4, frictional resistance due to the refrigerant may occur in the flat tubes 4 to cause a pressure loss of the refrigerant. Also, when the pressure loss of the refrigerant occurs, heat exchange efficiency in the heat exchanger may be reduced.

DISCLOSURE OF INVENTION

Technical Problem

Embodiments provide an air conditioner having improved heat exchange efficiency.

Solution to Problem

In one embodiment, a heat exchanger includes: a plurality of refrigerant tubes in which a refrigerant flows; a heatsink fin coupled to the plurality of refrigerant tubes to heat-exchange the refrigerant with a fluid; a header disposed on at least one side of the plurality of refrigerant tubes to define a flow space of the refrigerant; and a guide device disposed in the header to partition the flow space, the guide device guiding the refrigerant from the header to the refrigerant tubes, wherein the guide device includes a movable cover part.

In another embodiment, a heat exchanger includes: a plurality of refrigerant tubes in which a refrigerant flows; a heatsink fin coupled to the plurality of refrigerant tubes to heat-exchange the refrigerant with a fluid; a header disposed on each of both sides of the plurality of refrigerant tubes to extend vertical; and a cover part disposed within the header to selectively open a refrigerant flow space of the header, wherein the cover part includes a plurality of cover members having thermal expansion coefficients different from each other.

Advantageous Effects of Invention

According to the proposed embodiments, since the guide device is provided within the header to guide the refrigerant flow, the heat exchange efficiency may be improved.

Particularly, when the heat exchanger serves as the condenser, the liquid refrigerant contained in the refrigerant may be collected into the lower portion of the header through the discharge hole. Thus, the gaseous refrigerant may be heat-exchanged on the refrigerant tube to prevent a pressure of the refrigerant from being lost.

Also, when the heat exchanger serves as the evaporator, since the discharge hole is covered to guide the refrigerant containing the liquid refrigerant into the refrigerant tube, the heat exchange of the liquid refrigerant may be effectively performed.

Also, the selectively openable cover part may be provided in the header to selectively open or close the discharge hole according to whether the heat exchanger serves as the condenser or the evaporator. Thus, the refrigerant channel may be effectively configured according to the characteristics of the refrigerant to improve the heat exchange efficiency.

Also, since the cover part is operated by a simple structure, manufacturing costs may be reduced. Thus, operation reliability of the cover part may be secured.

BRIEF DESCRIPTION OF DRAWINGS

FIG. 1 is a perspective view of a heat exchanger according to a first embodiment.

FIG. 2 is a cross-sectional view taken along line I-I' of FIG. 1.

FIG. 3 is a cross-sectional view taken along line II-II' of FIG. 1.

FIG. 4 is an enlarged view of a portion A of FIG. 3.

FIG. 5 is a view illustrating a refrigerant flow when the heat exchanger serves as a condenser.

FIG. 6 is a view illustrating a refrigerant flow when the heat exchanger serves as an evaporator.

FIG. 7 is a view of a guide device according to a second embodiment.

FIG. 8 is a view illustrating a refrigerant flow when a heat exchanger serves as a condenser according to a third embodiment.

FIG. 9 is a view illustrating a refrigerant flow when the heat exchanger serves as an evaporator according to the third embodiment.

FIG. 10 is a view of a guide device according to a fourth embodiment.

FIG. 11 is a view of a heat exchanger according to a related art.

MODE FOR THE INVENTION

Reference will now be made in detail to the embodiments of the present disclosure, examples of which are illustrated in the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

FIG. 1 is a perspective view of a heat exchanger according to a first embodiment. FIG. 2 is a cross-sectional view taken along line I-I' of FIG. 1. FIG. 3 is a cross-sectional view taken along line II-II' of FIG. 1.

Referring to FIGS. 1 to 3, a heat exchanger 10 according to a first embodiment includes headers 50 and 60 extending vertically by a predetermined length, a plurality of flat tubes 20 coupled to the headers 50 and 60 to extend horizontally, thereby serving as a refrigerant tube, and a plurality of heatsink fins 30 arranged at a predetermined distance between the headers 50 and 60 and through which the flat tubes 20 pass. Each of the headers 50 and 60 may be called a "vertical type header" in that each of the headers 50 and 60 extends in a vertical direction. a1

In detail, the headers 50 and 60 include a first header 50 including first and second entrance parts 51 and 52 through which a refrigerant is introduced into or discharged from the heat exchanger 10 and a second header 60 spaced from the first header 50. An end of one side of each of plurality of flat tubes 20 may be coupled to the first header 50, and an end of the other side may be coupled to the second header 60.

A flow space of the refrigerant is defined within the first and second headers 50 and 60. The refrigerant within the first or second header 50 or 60 may be introduced into the flat tubes 20, and the refrigerant flowing into the flat tubes 20 may be switched in flow direction within the first or second header 50 or 60.

For example, the refrigerant flowing in a left direction through the flat tubes 20 may be switched in flow direction within the first header to flow in a right direction. Also, the refrigerant flowing in a right direction through the flat tubes 20 may be switched in flow direction within the second header 60 to flow in a left direction (see FIGS. 5 and 6). Thus, the first or second header 50 or 60 may be called a "return header".

The first entrance part 51 may be disposed on a lower portion of the first header 50, and the second entrance part 55 may be disposed on an upper portion of the first header 50.

For example, when the heat exchanger 10 serves as an evaporator, the refrigerant may be introduced through the first entrance part 51. Then, the refrigerant may be circulated into the flat tubes 20 to flow in a direction opposite to the gravity. Thereafter, the refrigerant may be discharged through the second entrance part 55. That is, the refrigerant may flow upward from the first entrance part 51 toward the second entrance part 55.

On the other hand, when the heat exchanger 10 serves as a condenser, the refrigerant may be introduced through the second entrance part 55. Then, the refrigerant may be circulated into the flat tubes 20 to flow in a gravity direction. Thereafter, the refrigerant may be discharged through the first entrance part 51. That is, the refrigerant may flow downward from the second entrance part 55 toward the first entrance part 51.

When the heat exchanger 10 serves as the evaporator, the refrigerant introduced into the first entrance part 51 may be a liquid refrigerant or a two-phase refrigerant having a low dryness degree. Also, the refrigerant discharged through the second entrance part 55 may be a gaseous refrigerant or a two-phase refrigerant having a high dryness degree. Thus, since the refrigerant may be increased in density and specific volume while passing through the heat exchanger 10, the number of flat tubes 20 through which the refrigerant passes may be increased, or a flow volume of the flat tubes may be gradually increased (see FIG. 3).

The flat tubes 20 may be provided in plurality between the first header 50 and the second header 60. The plurality of flat tubes 20 may be spaced apart from each other in a horizontal direction.

Each of the flat tubes 20 includes a tube body 21 defining an outer appearance thereof and a partition rib 22 for defining a plurality of micro channels 25 within the tube body 10. The refrigerant introduced into the flat tubes 20 may be uniformly distributed into the plurality of micro channels to flow. Also, the heatsink fin 30 has through holes 32 through which the plurality of flat tubes pass.

A guide device 100 for guiding a flow of the refrigerant is provided within the first or second header 50 or 60. The guide device 100 may be disposed to partition an inner space of the first or second header 50 or 60 into upper and lower portions.

The guide device 100 may guide the refrigerant so that the refrigerant flow into the first header 50, the flat tubes 20, and the second header 60 in a zigzag shape. A channel of the refrigerant flowing along the flat tubes 20 may be provided as a meander line having an S shape by the guide device 100. Since the channel of the refrigerant flowing along the flat tubes 20 is provided as the meander line, a contact area and time between the refrigerant and air may be increased to improve heat exchange efficiency.

The guide device 100 may be provided in plurality. The plurality of guide devices 100 may be spaced apart from each other in a length direction of the headers 50 and 60. Thus, an inner space of the first or second header 50 or 60 may be partitioned into a plurality of flow spaces by the plurality of guide devices 100. A structure of the guide device 100 will be described below with reference to the accompanying drawings.

FIG. 4 is an enlarged view of a portion A of FIG. 3.

Referring to FIG. 4, the guide device 100 according to the first embodiment includes a support part 110 disposed to pass through the inner space of the header 60 and cover parts 121 and 125 movably disposed on one side of the support part 110.

In detail, the header 60 includes a first coupling part 60*a* coupled to the flat tube 20 and a second coupling part 60*b* disposed on a side surface facing the first coupling part 60*a*.

The support part 110 extends from the first coupling part 60*a* toward the second coupling part 60*b*. That is, the support part 110 may have one end coupled to the first coupling part 60*a* and the other end coupled to the second coupling part 60*b*.

The support part 110 has a discharge hole 115 defined by cutting at least one portion thereof. The discharge hole 115 may be understood as a part through which a liquid refrigerant contained in the refrigerant passes downward while the refrigerant flow into a side of the support part 110.

The support part 110 includes the cover parts 121 and 125 for selectively opening or closing the discharge hole 115 and a fixing part 130 for movably fixing the cover parts 121 and 125 on a side thereof. The cover parts 121 and 125 may be disposed to contact an upper or lower portion of the support part 110.

Each of the cover parts 121 and 125 may have one end fixed to the fixing part 130 and the other movable end. Thus, the one end may be called a "fixed end", and the other end may be called a "free end".

The cover part 121 and 125 include a first cover member 121 and a second cover member 125 which have thermal expansion coefficients different from each other. The first cover member 121 is coupled to an upper portion of the second cover member 125. Also, the first cover member 121 may be deformed in one direction according to a surrounding temperature. Here, the one direction may be a direction in which the cover member having a relatively high thermal expansion coefficient is deformed toward the cover member having a relatively low thermal expansion coefficient.

For example, the first cover member 121 may have a thermal expansion coefficient greater than that of the second cover member 125. Also, when the surrounding temperature of the cover members 121 and 125 is greater than a set temperature, the first cover member 121 may be deformed toward the second cover member 125.

Thus, the free end may be moved downward with respect to a center of the fixed end. As a result, it may be understood that the cover members 121 and 125 are rotated downward using the fixed end as a rotation center. When the cover members 121 and 125 are rotated, the discharge hole 115 may be opened.

When the discharge hole 115 is opened, the liquid refrigerant of the refrigerant flowing toward an upper side of the guide device 110 may be flow downward by its self-weight. Also, the gaseous refrigerant may flow toward the flat tubes 20.

On the other hand, when the surrounding temperature of the cover parts 121 and 125 is less than the set temperature, each of the cover parts 121 and 125 returns to its original position, i.e., contacts one side of the support part 110. When each of the cover parts 121 and 125 is restored, the cover parts 121 and 125 cover the discharge hole 115.

When the discharge hole 115 is covered, the refrigerant flowing toward the upper side of the guide device 110 may flow toward the flat tubes 20.

Hereinafter, when the heat exchanger serves as the condenser or evaporator, an effect of the guide device 100 and a flow of the refrigerant will be described with reference to the accompanying drawings.

FIG. 5 is a view illustrating a refrigerant flow when the heat exchanger serves as a condenser. FIG. 6 is a view illustrating a refrigerant flow when the heat exchanger serves as an evaporator.

Referring to FIG. 5, the heat exchanger 10 may serve as the condenser. For example, the heat exchanger 10 may introduce the gaseous refrigerant compressed by a compressor (not shown) and discharges the liquid refrigerant.

In detail, the refrigerant is introduced into the heat exchanger 10 through the second entrance part 55. The refrigerant introduced into the heat exchanger 10 is heat-exchanged with an external fluid while the refrigerant passes through the flat tubes 20. The heatsink fin 30 may assist the heat-exchanging between the refrigerant and the external fluid.

While the refrigerant is heat-exchanged, at least one portion of the gaseous refrigerant may be phase-changed into a liquid refrigerant. Thus, the refrigerant may have a two-phase state. Also, as a path of the refrigerant circulating the flat tube 20 is increased, a ratio of the liquid refrigerant to the refrigerant is increased. Thus, the refrigerant may have a two-phase state having a low dryness degree.

When the refrigerant having the two-phase state passes through the flat tubes 20, frictional resistance between the flat tubes and the refrigerant may be increased. Thus, heat transfer performance may be deteriorated. Also, since the liquid refrigerant of the refrigerant flowing into the flat tubes 20 is a refrigerant which is condensed already. Thus, it may be unnecessary to heat-exchange the refrigerant.

Thus, in the current embodiment, the liquid refrigerant of the refrigerant flowing into the flat tubes 20 may be separated and then collected into lower portions of the headers 50 and 60. Thus, the gaseous refrigerant may be heat-exchanged on the flat tubes 20.

In detail, the cover parts 121 and 125 of the guide device 100 may be opened. The cover parts 121 and 125 may be deformed at a temperature greater than the set temperature to open the discharge hole 115. Here, the set temperature may be set to one value or a value having a predetermined range with a temperature range less than a refrigerant temperature during the condensing process, i.e., a condensation temperature (e.g., about 30° C. to about 50° C.).

That is, when the surrounding temperature of the cover parts 121 and 125 is greater than the set temperature by the condensed refrigerant flowing into the headers 50 and 60, the cover parts 121 and 125 may be deformed and rotated downward. Here, the first cover member 121 having a relatively high thermal expansion coefficient may be bent in a direction of the second cover member 125.

In summary, as shown in FIG. 5, the plurality of cover parts 121 and 125 disposed within the first and second headers 50 and 60 may be opened. Thus, the liquid refrigerant of the refrigerant flowing into one side of the cover parts 121 and 125 may pass through the discharge hole 115 to flow downward (a dotted arrow).

Thus, the gaseous refrigerant may be heat-exchanged on the flat tubes 20. Thus, pressure drop occurring while the two-phase refrigerant flows into the flat tubes 20 may be prevented.

Also, the liquid refrigerant generated while the gaseous refrigerant is circulated into the flat tubes 20 may be discharged downward through the next discharge hole 115 with respect to the flow path of the refrigerant. As a result, the liquid refrigerant discharged through the plurality of discharge holes 115 may be collected into the lower portions of the headers 50 and 60.

Thus, the liquid refrigerant does not pass through the flat tubes 20, but is collected into lower ends of the headers 50 and 60. Thus, the collected refrigerant may be discharged to the outside of the heat exchanger 10 through the first entrance part 51.

Referring to FIG. 6, the heat exchanger 10 may serve as the evaporator. For example, the heat exchanger 10 may introduce the liquid refrigerant decompressed in an expansion device (not shown) or the two-phase refrigerant having a low dryness degree to evaporate the introduced refrigerant, thereby discharging a gaseous refrigerant.

In detail, the refrigerant may be introduced into the heat exchanger 10 through the first entrance part 51. The refrigerant introduced into the heat exchanger 10 is heat-exchanged with an external fluid while passing through the flat tubes, thereby being evaporated. Also, while the refrigerant is heat-exchanged, at least one portion of the liquid refrigerant is phase-changed into a gaseous refrigerant.

Also, the cover parts 121 and 125 of the guide device 100 may be covered. The cover parts 121 and 125 may be restored at a temperature less that the set temperature to cover the discharge hole 115. In general, a temperature, i.e., an evaporation temperature of the refrigerant while the refrigerant is evaporated may be less (e.g., about 10° C.) than the condensation temperate. Also, the cover parts 121 and 125 may be restored within a range of the evaporation temperature.

In summary, the set temperature may be set to an adequate value so that the cover parts 121 and 125 are selectively deformed according to the flow of the condensed refrigerant or the evaporated refrigerant. Here, the range may be changed according to a kind of refrigerant. For example, the set temperature may be decided within a range of about 20° C. to about 25° C.

When the evaporated refrigerant flows into the headers 50 and 60, the cover parts 121 and 125 may be restored (rotated upward) to cover the discharge hole 115. Thus, the support part 110 and the cover parts 121 and 125 may be disposed to vertically partition the inner spaces of the headers 50 and 60.

As shown in FIG. 6, when the refrigerant reaches one side of the guide device 100, the refrigerant does not pass through the discharge hole 115. As a result, the refrigerant may be guided by the support part 110 and the cover parts 121 and 125 to flow into the flat tubes 20 (a solid arrow).

As described above, when the heat exchanger 10 serves as the evaporator so that the liquid refrigerant is phase-changed into a gaseous refrigerant while passing through the flat tubes 20, it may prevent the liquid refrigerant from being discharged downward to improve the heat transfer performance.

Hereinafter, a second embodiment will be described. This embodiment is the same as the first embodiment except for a structure of a guide device. Thus, the same part as the first embodiment will be denoted by the description and reference numeral of the first embodiment.

FIG. 7 is a view of a guide device according to a second embodiment.

Referring to FIG. 7, a guide device 200 according to the second embodiment includes a support part 210 coupled to the insides of the headers 50 and 60 and having a discharge hole 215, a cover part 220 movably disposed on the support part 210 to selectively open or close the discharge hole 215, and an elastic member 240 for providing a restoring force into the cover part 220.

The cover part 220 is rotatably coupled to a lower portion of the support part 210 by a hinge part 230. In detail, the cover part 220 has one end coupled to the support part 210 through the hinge part 230 and the other end which is movable to serve as a free end.

When the cover part 220 is rotated downward by a predetermined pressure, the discharge hole 215 is opened, and the elastic member 240 is extended. On the other hand, when the predetermined pressure is released, the cover part 220 may be rotated upward by a restoring force of the elastic member 240 to cover the discharge hole 215.

The predetermined pressure may be understood as a flow force (a force due to a mass flow) of the liquid refrigerant of the refrigerant flowing into an upper side of the cover part 220. Also, an elastic modulus of the elastic member 240 may be determined within a range in which the elastic member 240 may be extended by the force due to the mass flow. A top surface of the cover part 220 may be understood as a "pressed surface" pressed by the refrigerant.

For example, when the heat exchanger 10 serves as the condenser, the gaseous refrigerant introduced through the second entrance part 55 is heat-exchanged while being moved downward toward the first entrance part 51. When the liquid refrigerant generated through the heat exchange reaches an upper side of the guide device 200, the liquid refrigerant presses the cover part 220 downward by its self-weight.

Thus, the cover part 220 overcomes the elastic force of the elastic member 240 and is rotated downward to open the discharge hole 215. Also, the liquid refrigerant is collected into lower portions of the headers 50 and 60 through the discharge hole 215.

On the other hand, when the heat exchanger serves as an evaporator, the refrigerant introduced through the first entrance part 51 is heat-exchanged while flowing upward toward the second entrance part 55. Also, the cover part 220 is rotated upward by a mass flow of the refrigerant flowing upward to cover the discharge hole 215. Here, a restoring force may be applied to the elastic member 240 and thus be compressed.

As described above, when the heat exchanger 10 serves as an evaporator, the discharge hole 215 may be covered to prevent the liquid refrigerant from being discharged downward. Thus, the liquid refrigerant may be heat-exchanged while flowing into the flat tube 20, and thus be easily phase-changed into a gaseous refrigerant.

FIG. 8 is a view illustrating a refrigerant flow when a heat exchanger serves as a condenser according to a third embodiment. FIG. 9 is a view illustrating a refrigerant flow when the heat exchanger serves as an evaporator according to the third embodiment.

Referring to FIGS. 8 and 9, a refrigerator 10 according to a third embodiment includes a plurality of guide devices disposed within headers 50 and 60 to guide a flow of a refrigerant.

The guide devices include a support part having a discharge hole and a cover part rotatably coupled to one side of the support part. An overall structure and operation of each of the guide devices are similar to that according to the first embodiment (see FIG. 4), and thus their detailed descriptions will be omitted.

However, in the current embodiment, two kinds of cover parts having different characteristics when a condensed refrigerant or an evaporated refrigerant flows.

In detail, one guide device of the plurality of guide devices includes a first cover part 321, and the other guide device includes a second cover part 325. The first cover part 321 and the second cover part 325 may be alternately disposed from upper portion of the headers 50 and 60 up to lower portions.

Each of the first cover part 321 and the second cover part 325 may include the first cover part 121 and the second cover part 125 of FIG. 4. In detail, in the first cover part 321 and the second cover part 325, the second cover member 125 may be coupled to a lower portion of the first cover member 121 having a relatively high thermal expansion coefficient.

When a condensed refrigerant flows, the first cover part 321 may cover a discharge hole. Also, when an evaporated refrigerant flows, the first cover part 321 may open the discharge hole. On the other hand, when the condensed refrigerant flows, the second cover part 325 may open the discharge hole. Also, when the evaporated refrigerant flows, the second cover part 325 may cover the discharge hole.

For these operations, the first cover part 321 may be coupled to an upper side of the discharge hole, and the second cover part 325 may be coupled to a lower side of the discharge hole.

A flow of a refrigerant when the heat exchanger 10 serves as a condenser will be described with reference to FIG. 8.

A gaseous refrigerant is introduced into the heat exchanger 10 through a second entrance part 55 to flow downward toward a first entrance part 51. Here, the refrigerant may flow in a zigzag shape by circulating a first header 50, a flat tube 20, and a second header 60.

Also, the first cover part 321 may cover the discharge hole by a temperature of the condensed refrigerant. Also, the second cover part 325 may open the discharge hole by the temperature of the condensed refrigerant.

When the refrigerant reaches the first cover part 321 while flowing into the headers 50 and 60, the refrigerant may be guided into the flat tube 20 by the first cover part 321 and the support part. On the other hand, when the refrigerant reaches the second cover part 325, the refrigerant may flow downward through the opened discharge hole. Thus, the refrigerant reaching a lower portion of the first header 50 may be discharged to the outside of the heat exchanger 10 through the first entrance part 51.

Also, as shown in FIG. 8, the liquid refrigerant may be discharged through the opened second cover part 325 disposed in the lower portions of the headers 50 and 60 (a dotted arrow). The discharged liquid refrigerant may flow into the first entrance part 51 and then be discharged to the outside of the heat exchanger 10.

When the heat exchanger 10 serves as an evaporator, as shown in FIG. 9, a liquid or two-phase refrigerant may be introduced into the heat exchanger 10 through the first entrance part 51 to flow upward toward the second entrance part 55. Here, the refrigerant may flow in a zigzag shape by circulating the first header 50, the flat tube 20, and the second header 60.

Also, the first cover part 321 may open the discharge hole by a temperature of the evaporated refrigerant. Also, the second cover part 325 may cover the discharge hole by the temperature of the evaporated refrigerant.

When the refrigerant reaches the first cover part 321 while flowing into the headers 50 and 60, the refrigerant flows upward through the opened discharge hole. On the other hand, when the refrigerant reaches the second cover part 325, the refrigerant is guided into the flat tube 20 by the first cover part 325 and the support part. For this refrigerant flow, the refrigerant reaching to an upper portion of the first header 50 may be discharged to the outside of the heat exchanger 10 through the second entrance part 55.

As described above, when the heat exchanger 10 serves as the condenser or evaporator and is switched in flow direction to flow upward or downward, portions of the plurality of cover parts may be opened so that the refrigerant passes through the guide device. Also, the remaining cover parts may allow the refrigerant to be guided by the guide device to flow into the flat tube 20. Thus, the refrigerant channel may be effectively configured. Thus, condensation efficiency and evaporation efficiency of the refrigerant using the heat exchanger 10 may be improved.

FIG. 10 is a view of a guide device according to a fourth embodiment. Comparing this embodiment to the forgoing embodiments, the fourth embodiment is different from the forgoing embodiments in a structure of a guide device. Thus, different points will be mainly described.

Referring to FIG. 10, headers 50 and 60 according to a fourth embodiment include a guide device 400 for guiding a refrigerant flow. The guide device 400 includes a support part 410 coupled to the inside of the first or second header 50 or 60 to define a discharge hole 415, a cover part 440 rotatably coupled to the support part 410, and a driving part 430 providing a driving force into the cover part 440. The cover part 440 may be disposed on an upper or lower side of the discharge hole 415.

The driving part 430 is disposed on a side of the support part 410. Also, the cover part 440 has one end connected to the driving part 430 and the other end which is movable to serve as a free end. When the driving part 430 is operated, the cover part 440 selectively opens or closes the discharge hole 415.

For example, when the heat exchanger 10 serves as a condenser, a refrigerant flows downward from a second entrance part 55 toward a first entrance part 51. Also, the cover part 440 may be rotated by the driving part 430 to open the discharge hole 415. Thus, a liquid refrigerant may be discharged downward through the opened discharge hole 415.

On the other hand, when the heat exchanger serves an evaporator, a refrigerant may flow upward from the first entrance part 51 toward the second entrance part 55. Also, the cover part 440 may cover the discharge hole 415 by the driving part 430. The refrigerant flow may be guided into the flat tube 20 from the headers 50 and 60 by the support part 410 and the cover part 440.

The driving part 430 may selectively rotate the cover part 440 according to a cooling or heating mode of an air conditioner. When the air conditioner is operated in the cooling mode, the heat exchanger 10 may serve as an evaporator. On the other hand, when the air conditioner is operated in the heating mode, the heat exchanger may serve as a condenser.

INDUSTRIAL APPLICABILITY

According to the embodiments, since the guide device is provided within the header to guide the refrigerant flow, the heat exchange efficiency may be improved. However, industrial applicability may be significantly high.

The invention claimed is:

1. A heat exchanger comprising:

a plurality of refrigerant tubes in which a refrigerant flows, the plurality of refrigerant tubes extending in a horizontal direction;

a heatsink fin coupled to the plurality of refrigerant tubes to heat-exchange the refrigerant with a fluid;

first and second headers, each of the first and second headers disposed on a respective side of the plurality of refrigerant tubes, each of the first header and the second header defining a flow space of the refrigerant, the first and second headers extending in a vertical direction;

a first port provided at a lower portion of the first header and a second port provided at an upper portion of the first header;

a first support part coupled to the inside of the first header to define a first discharge hole through which the refrigerant flows;

a first cover part disposed to contact the first support part and configured to close the first discharge hole, the first cover part including a first cover member and a second cover member, the first cover member having a different thermal expansion coefficient than the second cover member, the first cover member being coupled to the second cover member and having a same shape and size as the second cover member;

a second support part coupled to the inside of the first header to define a second discharge hole through which the refrigerant flows, the second support part being located under the first support part and a first flow space being defined between the first and second support parts;

a second cover part disposed to contact the second support part and configured to close the second discharge hole, the second cover part including a first cover member and a second cover member, the first cover member having a different thermal expansion coefficient than the second cover member, the first cover member being coupled to the second cover member and having a same shape and size as the second cover member;

a third support part coupled to the inside of the first header to define a third discharge hole through which the refrigerant flows, the third support part being located under the second support part and a second flow space being defined between the second and third support parts; and a third cover part disposed to contact the third support part and configured to close the third discharge hole, the third cover part including a first cover member and a second cover member, the first cover member having a different thermal expansion coefficient than the second cover member, the first cover member being coupled to the second cover member and having a same shape and size as the second cover member, wherein the second cover part is located beneath the second support part and the third cover part is located on the third support part such that the second and the third cover parts are disposed within the second flow space, wherein, when the refrigerant is introduced into the first header through the second port and is discharged from the first header through the first port, the second cover part rotates downward to open the second discharge hole while the first and third cover parts remain closed, and wherein, when the refrigerant is introduced into the first header through the first port and is discharged from the first header through the second port, the first and third cover parts rotate upward to open the first and third discharge holes while the second cover part of the second support part remains closed.

2. The heat exchanger according to claim 1, wherein each of the support parts extend from one surface of the first header toward an other surface to cross an inner space of the first header.

3. The heat exchanger according to claim 1, wherein:

the first port allows the refrigerant to be introduced into the first header when the heat exchanger serves as the evaporator and allows the refrigerant to be discharged from the flow space of the first header when the heat exchanger serves as the condenser; and the second port allows the refrigerant to be discharged from the first header when the heat exchanger serves as the evaporator and allows the refrigerant to be introduced into the flow space of the first header when the heat exchanger serves as the condenser.

* * * * *